US010281871B2

(12) United States Patent
Yoshimune et al.

(10) Patent No.: US 10,281,871 B2
(45) Date of Patent: May 7, 2019

(54) IMAGE FORMING APPARATUS WITH A LIGHT SHIELDING PART SERVING AS A GUIDE FOR A DETACHABLE CARTRIDGE

(71) Applicant: Brother Kogyo Kabushiki Kaisha, Nagoya (JP)

(72) Inventors: Hideaki Yoshimune, Nagoya (JP); Tomoyuki Mizuno, Nagoya (JP); Masahito Saeki, Nagoya (JP); Tomoya Yamamoto, Kasugai (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 15/911,467

(22) Filed: Mar. 5, 2018

(65) Prior Publication Data

US 2018/0335750 A1 Nov. 22, 2018

(30) Foreign Application Priority Data

May 17, 2017 (JP) ..... 2017-097799

(51) Int. Cl.

| | |
|---|---|
| ***G03G 21/16*** | (2006.01) |
| ***G03G 21/18*** | (2006.01) |
| ***G03G 15/04*** | (2006.01) |
| *G03G 15/00* | (2006.01) |
| *G03G 15/08* | (2006.01) |

(52) U.S. Cl.

CPC ..... *G03G 21/18* (2013.01); *G03G 15/04036* (2013.01); *G03G 21/1842* (2013.01); *G03G 21/1896* (2013.01); *G03G 15/0856* (2013.01); *G03G 15/6555* (2013.01); *G03G 21/1633* (2013.01)

(58) Field of Classification Search

USPC ..... 399/12, 107, 110–114, 125

See application file for complete search history.

(56) References Cited

U.S. PATENT DOCUMENTS

| | | | | |
|---|---|---|---|---|
| 8,948,617 | B2 * | 2/2015 | Shiraki | G03G 21/1896 399/12 |
| 9,182,740 | B2 * | 11/2015 | Shimizu | G03G 21/1821 |
| 2001/0050706 | A1 | 12/2001 | Ishii | |
| 2012/0070185 | A1 | 3/2012 | Yokota | |
| 2015/0125178 | A1 | 5/2015 | Sakuma et al. | |

FOREIGN PATENT DOCUMENTS

| | | |
|---|---|---|
| JP | 2001-350339 A | 12/2001 |
| JP | 2012-068371 A | 4/2012 |
| JP | 2014-016493 A | 1/2014 |

* cited by examiner

*Primary Examiner* — Hoan H Tran

(74) *Attorney, Agent, or Firm* — Burr & Brown, PLLC

(57) ABSTRACT

An image forming apparatus has a first opening on a side surface of the casing, first and second frames, a cartridge detachably attached through the first opening, and light receiver and light emitter respectively provided to the first and second frames. The cartridge shields the light from the light emitted when attached to an attachment position. The first and second frames face across the attachment position. The light reaches the light receiver when the cartridge is detached from the casing. A door is movably secured to the casing between closing and opening positions, and a second opening allowing a sheet to pass through is formed on the door. External light entering through the second opening and directed toward the light receiver is shielded by a light shielding part provided to the first frame, which also serves as a guiding part to guide attachment of the cartridge.

8 Claims, 14 Drawing Sheets

1

IMAGE FORMING APPARATUS WITH A LIGHT SHIELDING PART SERVING AS A GUIDE FOR A DETACHABLE CARTRIDGE

CROSS-REFERENCE TO RELATED APPLICATIONS

This application claims priority under 35 U.S.C. § 119 from Japanese Patent Application No. 2017-097799 filed on May 17, 2017. The entire subject matter of the application is incorporated herein by reference.

BACKGROUND

Technical Field

The present disclosures relate to an image forming apparatus.

Related Art

Conventionally, there has been known a cartridge type image forming apparatus which is configured such that a cartridge is detachably attached inside a main body of the image forming apparatus. The cartridge is configured such that, for example, a photosensitive drum and a developing roller configured to supply toner to the photosensitive drum to form a toner image are integrally held by a frame.

In the cartridge type image forming apparatus, typically, an opening is formed on a front surface of the main body, and a front door for opening/closing the opening is provided. When the front door is opened, the opening is exposed to outside. In this state, the cartridge can be inserted in the main body through the opening, and can be removed from the main body through the opening.

Further, in the main body, a photosensor for detecting an attached/detached state of the cartridge is provide inside the main body. The photosensor includes a light emitter and a light receiver. The light emitter and the light receiver are arranged on right and left sides, in the right-left direction, inside the main body at a position where the cartridge is attached.

SUMMARY

In accordance with recent trend of downsizing of the image forming apparatus, a distance between the cartridge and the front door tends to be small, and the photosensor is to be arranged at a position as close as possible to the front door. If the image forming apparatus is configured such that a paper feeding port through which a sheet is manually fed is formed on the front door, external light such as room light may enter the main body through the paper feeding port. If such external light reaches the light receiver, the photosensor may malfunction.

When the cartridge is configured to be divided into a developing assembly containing the developing roller and a toner box, in comparison with a case where the developing assembly and the toner box are arranged integrally, the photosensor for detecting the state of the toner box is arranged at a position closer to the front door. Therefore, when the cartridge is configured to be divided into two assemblies as described above, a more strict light shielding measure is required.

In the downsized image forming apparatus, however, many components are arranged in a small space in the main body, there is little space for applying a countermeasure, and a particular design for shielding the external light is necessary.

According to aspects of the present disclosures, there is provided an image forming apparatus having a casing having a first opening on a side surface of the casing, a first frame and a second frame, arranged inside the casing and facing each other in a direction parallel to the side surface, a cartridge detachably attached to, through the first opening, an attachment position defined between the first frame and the second frame, a photosensor including a light receiver provided to the first frame and a light emitter provided to the second frame and configured to emit light toward the light receiver, the light receiver being positioned such that the light emitted by the light emitter is shielded by the cartridge and does not reach the light receiver when the cartridge is attached to the attachment position, while the light emitted by the light emitter reaches the light receiver when the cartridge is detached from the attachment position, a door movably secured to the casing, the door being movable between a closing position to close the first opening an opening position to open the first opening, a second opening allowing a sheet to pass through being formed on the door, and a light shielding part provided to the first frame, the light shielding part being located between the light receiver and the second opening when the door is located at the closing position so that external light entering the casing through the second opening and directed toward the light receiver is shielded by the light shielding part. The light shielding part serves as a guiding part to guide the cartridge toward the attachment position.

According to aspects of the present disclosures, there is provided an image forming apparatus, which is provided with a casing having a first opening, a door movable between a closing position to close the first opening and an opening position to open the first opening, the door having a second opening allowing a sheet to pass through the door, a cartridge detachably attached to, through the first opening, an attachment position inside the casing, a first frame arranged inside the casing. The first frame is provided with a light receiver configured to detect light and a first guiding part configured to guide the cartridge toward the attachment position. A part of the first guiding part is located between the light receiver and the second opening when the door is located at the closing position so that external light entering the casing through the second opening and directed toward the light receiver is shielded by the part of the first guiding part, a second frame arranged inside the casing, the second frame facing the first frame across the cartridge when the cartridge is attached at the attachment position, the second frame is provided with a light emitter configured to emit light, the light emitter facing the photo light receiver across the cartridge when the cartridge is attached at the attachment position, and a second guiding part configured to guide the cartridge toward the attachment position.

BRIEF DESCRIPTION OF THE ACCOMPANYING DRAWINGS

DETAILED DESCRIPTION OF THE EMBODIMENT

Hereinafter, referring to the accompanying drawings, an embodiment of the present disclosures will be described.

<Appearance of Printer>

Figure 1:
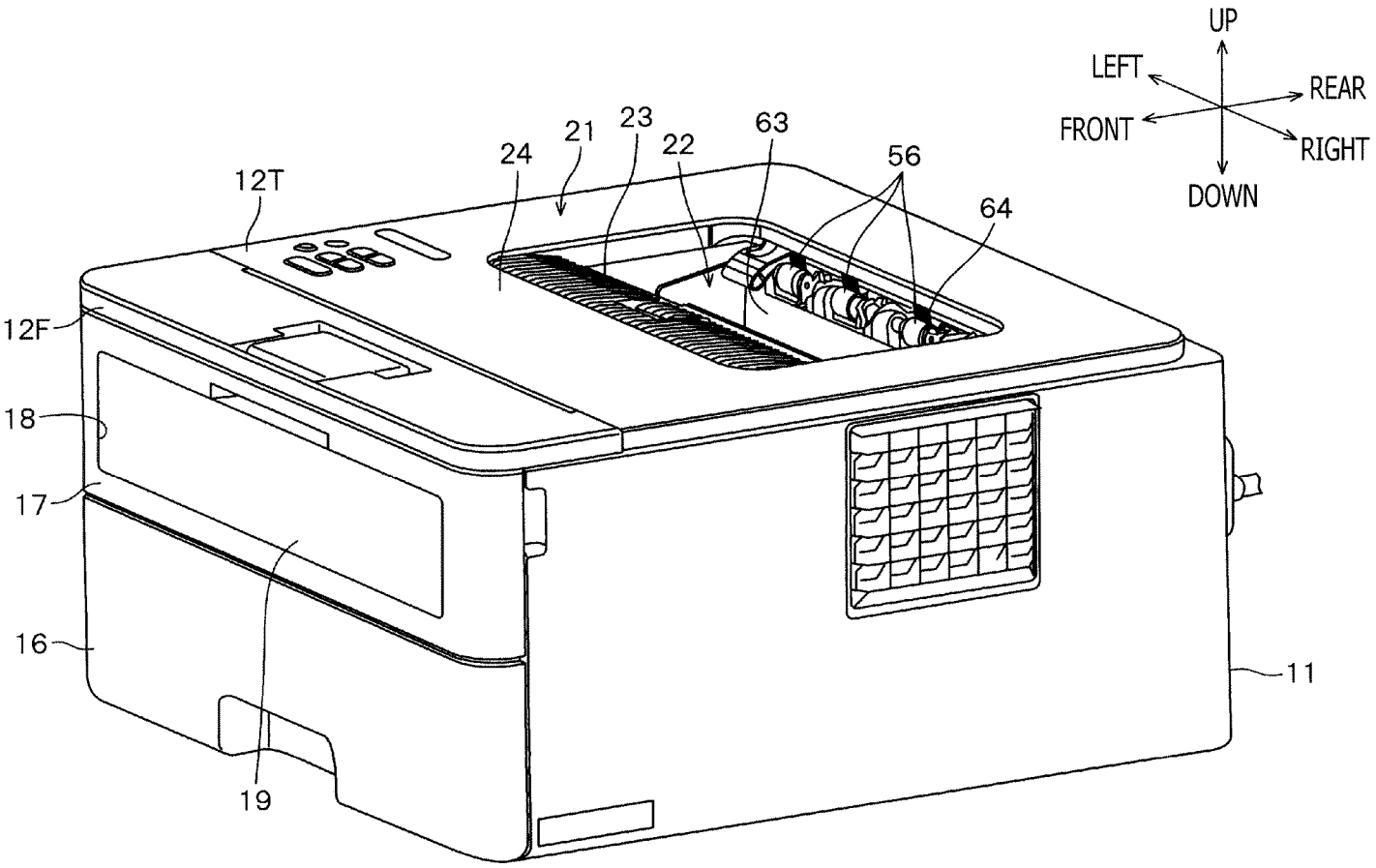
FIG. 1 is a perspective view, viewed from a right front side, of a printer according to an embodiment of the present disclosure showing a state where a front cover is located at an open position and a multi-purpose tray is located at an unused position.

FIG. 1 is a perspective view of a printer 1 according to an embodiment of the present disclosures. The printer 1 is a monochromatic laser printer, which is an example of an image forming apparatus.

Figure 2:
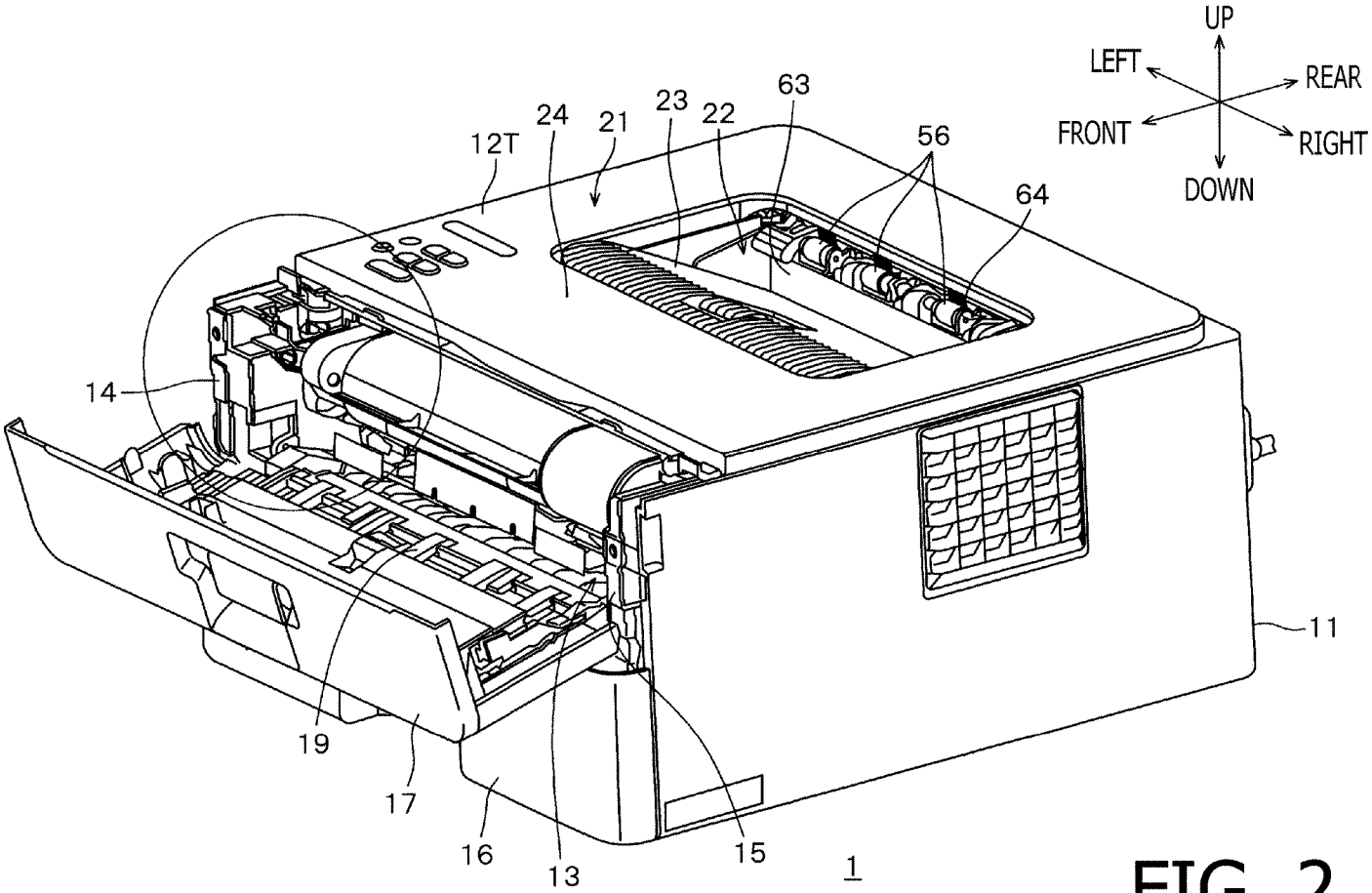
FIG. 2 is a perspective view, viewed from the right front side, of the printer showing a state where the front cover is located at the open position.

The printer 1 has a casing 11 configuring an outer appearance of the printer 1. The casing 11 has a substantially rectangular parallelepiped shape. The casing 11 has a first opening 13 which extends over one side surface 12F and an upper surface 12T as shown in FIG. 2.

Hereinafter, for the sake of description, front, rear, right and left sides are defined as follows. A side where the first opening 13 is defined as the front side of the printer, and an opposite side of the printer 1 is defined as the rear side. Thus, the one side surface 12F is the front surface of the casing 11. When the printer 1 is viewed from the front side, the right and left sides of the printer 1 are defined as a right-hand side and a left-hand side, respectively. Arrows indicating the directions based on the above definition are indicated in each drawing.

Figure 3:
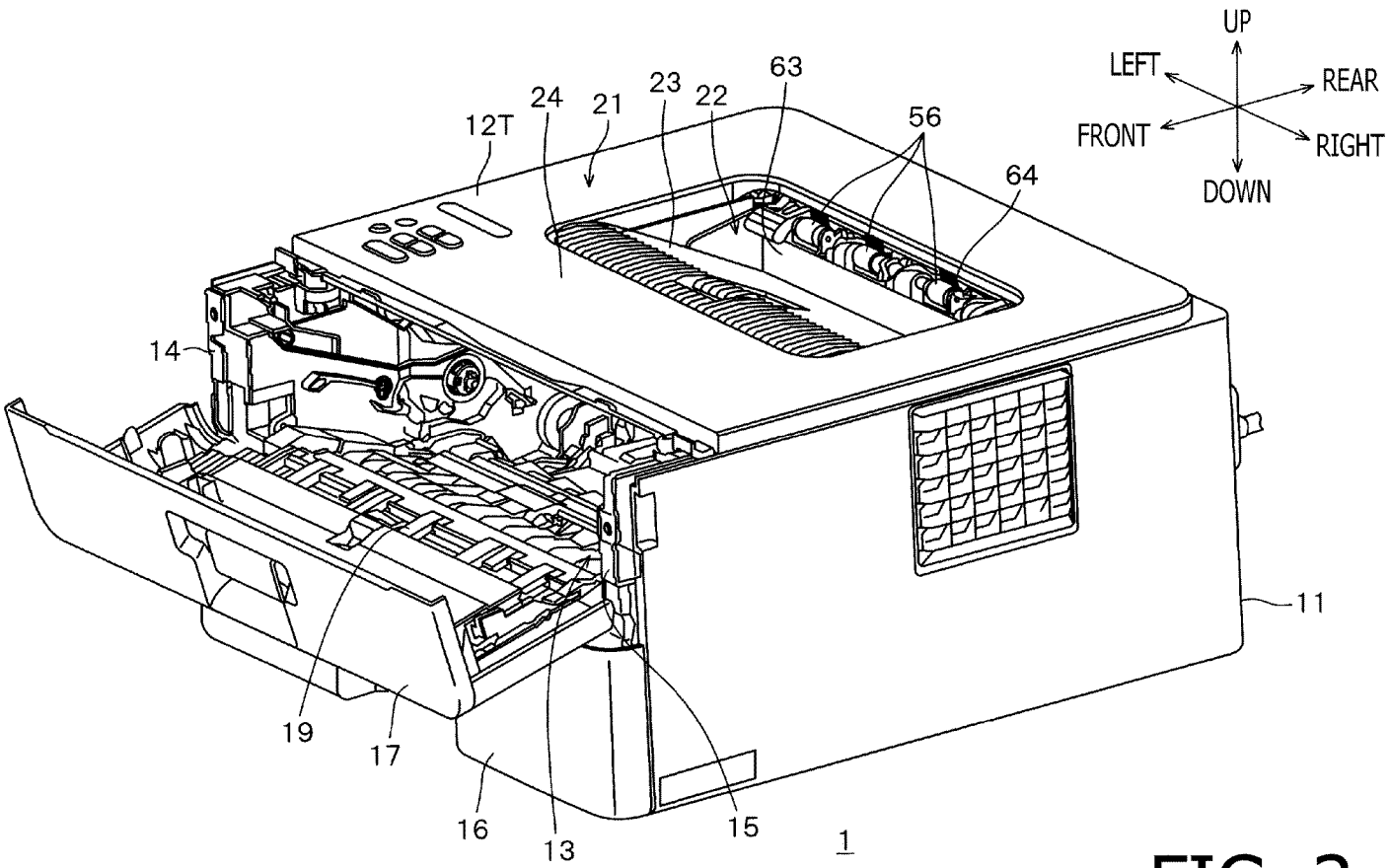
FIG. 3 is a perspective view, viewed from the right front side, of the printer showing a state where the front cover is located at the open position and a process cartridge is detached from a cartridge attachment position.
Figure 4:
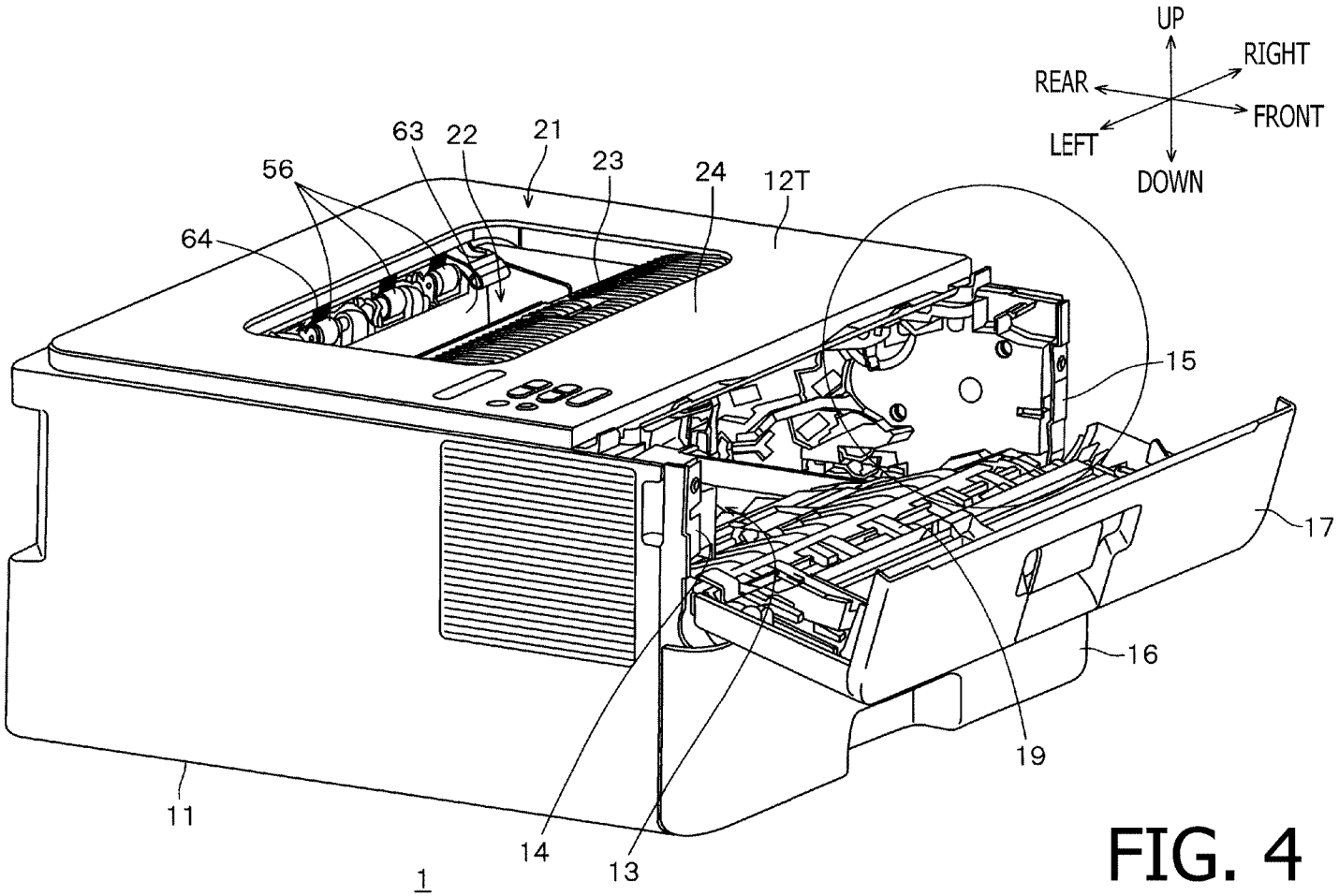
FIG. 4 is a perspective view, viewed from a left front side, of the printer showing a state where the front cover is located at the open position and the process cartridge is detached from the cartridge attachment position.

The casing 11 has a first frame 14 and a second frame 15, both made of resin. The first frame 14 is arranged on the left side with respect to the first opening 13 as shown in FIG. 3. The second frame 15 is arranged on the right side with respect to the first opening 13 as shown in FIG. 4. That is, the first frame 14 and the second frame 15 are arranged opposite to each other with the first opening 13 being located therebetween.

On a bottom part of the casing 11, the sheet feed tray 16 is removably inserted. In other words, at a lower part of a space defined between the first frame 14 and the second frame 15, an attachment position of the sheet feed tray 16 is defined. The sheet feed tray 16 is attached to the attachment position such that the sheet feed tray 16 can be drawn frontward from the attachment position. The sheet feed tray 16 is configured to support a plurality of sheets (e.g., printing sheets) in a stacked state.

Above a front end part of the sheet feed tray 16 attached to the attachment position, a front cover 17 is provided. The front cover 17 is rotatably supported by a front frame 200 provided between the first frame 14 and the second frame 25. The front cover 17 can be located at an opening position (see FIG. 2), at which the front cover 17 is lodged frontward to expose a first opening 13 between the first frame 14 and the second frame 15 to outside, and a closing position (see FIG. 1) at which the front cover 17 covers an upper part of a front end surface, and a front part of an upper end surface of each of the first frame 14 and the second frame 15, thereby closing the first opening 13.

Figure 5:
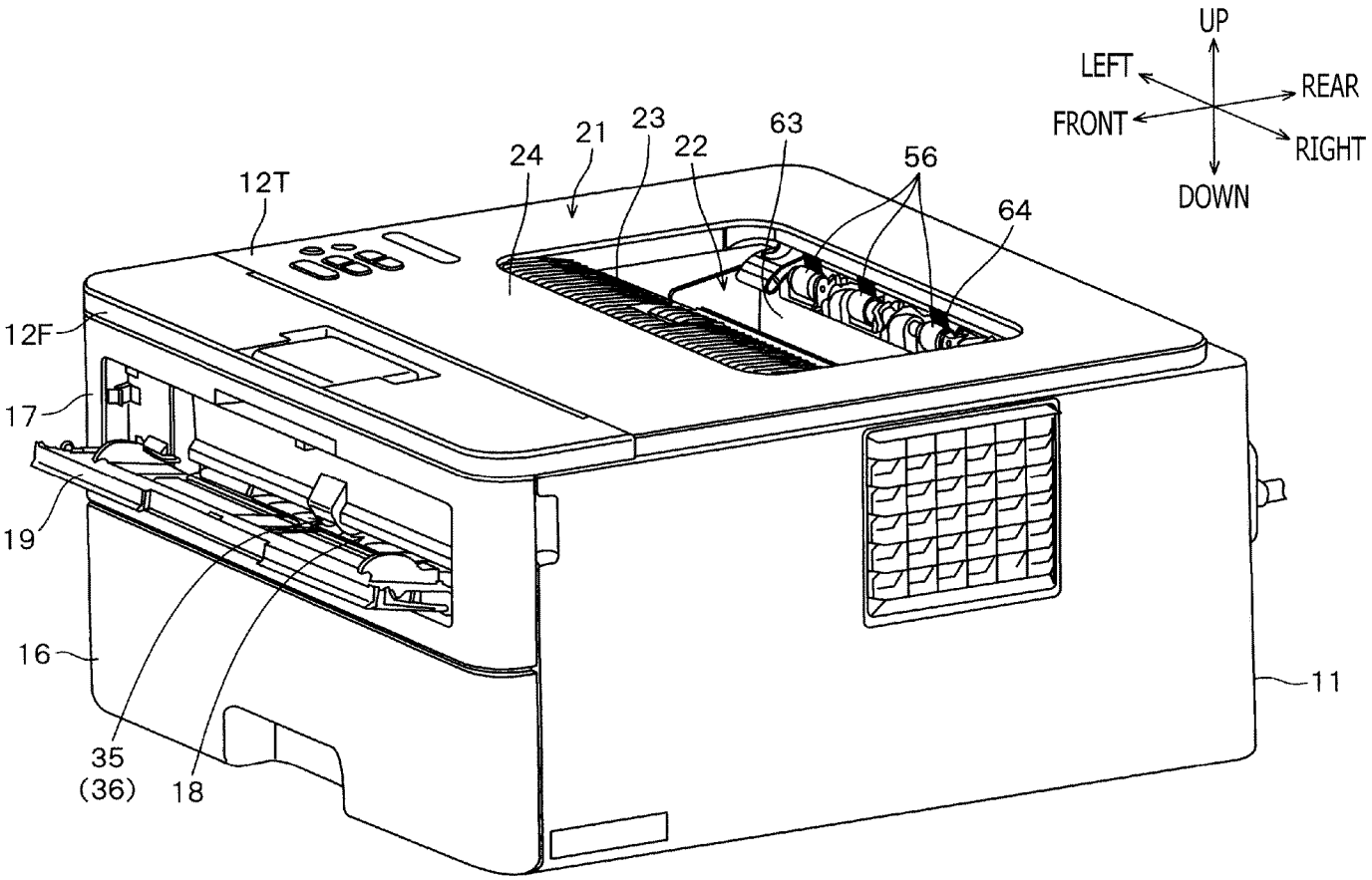
FIG. 5 is a perspective view, viewed from a right front side, of the printer showing a state where the multi-purpose tray is located at the used position.

As shown in FIG. 5, a second opening 18 is formed on the front cover 17. Further, a multi-purpose tray 19 is provided to the front cover 17. The multi-purpose tray 19 is configured to be displaced between an unused position at which the multi-purpose tray 19 extends in the up-down direction along a front surface of the front cover 17 located at the closing position, and a used position at which the multi-purpose tray 19 is lodged frontward from the unused position with being slightly inclined such that a front end thereof is slightly lifted. The multi-purpose tray 19 is configured to support a plurality of sheets in a stacked state when located at the used position. Further, when the multi-purpose tray 19 is located at the used position, the paper feeding port communicating inside and outside of the casing 11 is opened inside the front cover 17.

The casing 11 is provided with a top cover 21 made of resin. The top cover 21 is arranged over the first frame 14 and the second frame 15, and covers the upper end surfaces thereof. On a position at a central part in the right-left direction and on a slightly rear side of the top cover 21, a concave part 22 configured to be concaved downward is formed. The concave part 22 has a rectangular shape in its plan view, and a bottom surface 23 thereof is formed to be downwardly inclined toward the rear end thereof. The bottom surface 23, in association with a part on the front side with respect to the concave part 22 on the upper surface of the top cover 21, and the upper surface of the front cover 17 when located at the closing position, constitutes a discharge tray 24.

<Inner Configuration of Printer>

Figure 6:
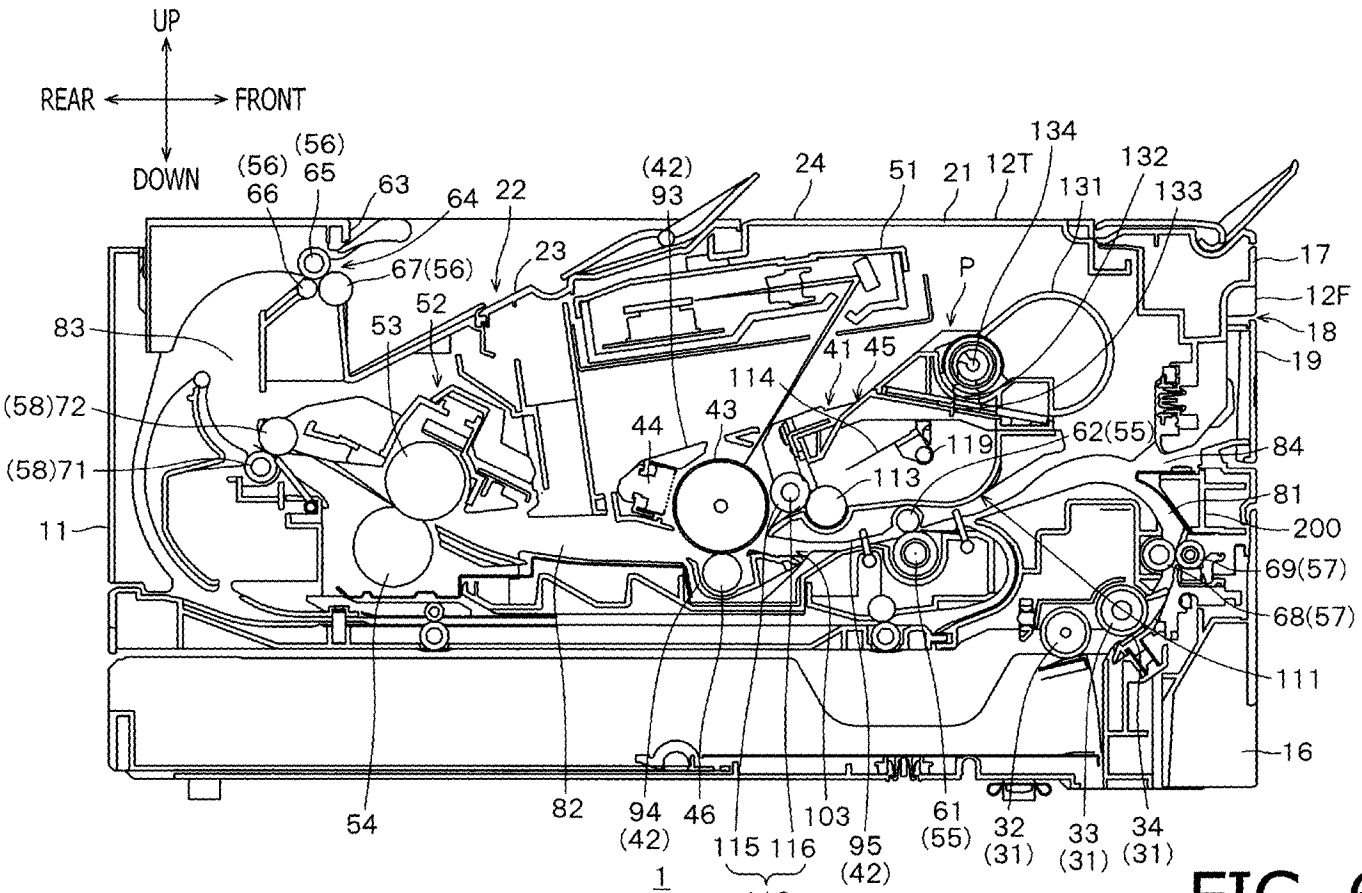
FIG. 6 is a cross-sectional side view of the printer.

Between the first frame 14 and the second frame 15, and above the front end part of the sheet feed tray 16, a first sheet feed mechanism 31 is provided as shown in FIG. 6. The first sheet feed mechanism 31 includes the sheet feed roller 32, the separation roller and the separation pad 34. The first sheet feed mechanism 31 includes a sheet feed roller 32, a separation roller 33 and a separation pad 34.

The sheet feed roller 32 is arranged to be rotatable about an axis extending in the right-left direction. when the sheet feed tray 16 is attached to the attachment position inside the casing 11, a circumferential surface of the sheet feed roller 32 contacts a front end part of the uppermost sheet of the plurality of sheets accommodated in the sheet feed tray 16.

The separation roller 33 is arranged on a front side with respect to the sheet feed roller, and is configured to rotate about an axis extending in the right-left direction.

The separation pad 34 contacts the circumferential surface of the separation roller 33 from a lower-front side thereof when the sheet feed tray 16 is attached to the attachment position inside the casing 11.

On a deep inner side (i.e., a rear side) of the second opening 18, which is opened when the multi-purpose tray 19 is located at the used position, a sheet feed mechanism 36 including the sheet feed roller 35 is provided as shown in FIG. 5.

On a deep inner side of the first sheet feed mechanism 31, a cartridge attachment position P, which is an example of an attachment position) is defined as shown in FIG. 6. At the cartridge attachment position P, the process cartridge 41, which is an example of a cartridge, is to be arranged.

The process cartridge 41 has a cartridge frame 42. A photosensitive drum 43, a charger 44, a developer 45 and a transfer roller 46 are held by the cartridge frame 42. In the following description, the positions of the photosensitive drum 43, the charger 44, the developer 45 and the transfer roller 46 when the process cartridge 41 is attached to the cartridge attachment position P will be basically referred to.

The photosensitive drum 43 is arranged on a front end part of the cartridge frame 42 so as to be rotatable about an axis extending in the right-left direction.

The charger 44 is arranged on a rear side with respect to the photosensitive drum 43. The charger 44 is, for example, a scorotron type charger provided with a wire and a grid.

The developer 45 is arranged on the front side with respect to the photosensitive drum 43.

The transfer roller 46 is arranged below the photosensitive drum 43 so as to face the photosensitive drum 43, and is configured to rotate about an axis extending in the right-left direction.

The process cartridge 41 can be attached to the cartridge attachment position P through the first opening 13 from outside of the casing 11, and can be drawn outside the casing 11 from the cartridge attachment position P through the first opening 13, with the front cover 17 being located at the opening position.

Inside the casing 11, an exposure device 51 is arranged above the cartridge attachment position P. The exposure device 51 is provided with an optical system including a laser source and a polygonal mirror, and is configured to emit a laser beam modulated in accordance with image data. The laser beam emitted by such an exposure device 51 is incident on the circumferential surface of the photosensitive drum 43 through a space between the charger 44 and the developer 45 with the process cartridge 41 being attached at the cartridge attachment position P.

Further, inside the casing 11, a fixing device 52 is arranged on the rear side with respect to the cartridge attachment position P. the fixing device 52 has a heat roller 53 and a pressure roller 54. The heat roller 53 is configured to rotate about an axis extending in the right-left direction. The pressure roller 54 is arranged below the heat roller 53, and is also configured to rotate about an axis extending in the right-left direction. A circumferential surface of the pressure roller 54 contacts a circumferential surface of the heat roller 53.

In the casing 11, registration rollers 55, discharge rollers 56, first conveying rollers 57 and second conveying rollers 58 are further provided.

The registration rollers 55 are arranged on the front side with respect to the photosensitive drum 43 and the transfer roller 46. The photosensitive drum 43 and the registration rollers 55 are arranged to have a particular distance therebetween. The registration rollers 55 include a pair of a driving roller 61 and a driven roller 62. The driving roller 61 is configured to rotate about an axis extending in the right-left direction, and held by the casing 11. The driven roller 62 is configured to rotate about an axis extending in the right-left direction, and is held by the cartridge frame 42 of the process cartridge 41. When the process cartridge 41 is attached to the cartridge attachment position P, a circumferential surface of the driven roller 62 contacts a circumferential surface of the driving roller 61 from an upper rear side.

The casing 11 is formed with a wall surface 63 which extends upward from a rear end of the discharge tray 24 (i.e., a rear end of the bottom surface 23 of the concave part 22). On the wall surface 63, a discharge port 64 through which the sheet is discharged onto the discharge tray 24 is formed at a position spaced upward from the rear end of the discharge tray 24. The discharge rollers 56 are arranged on the rear side with respect to the discharge port 64. The discharge rollers 56 include a driving roller 65 and two driven rollers 66 and 67. Each of the driving roller 67 and the driven rollers 66 and 67 is configured to rotate about an axis extending in the right-left direction. Circumferential surfaces of the driving roller 67 and the driven rollers 66 and 67 contact each other.

The first conveying rollers 57 are arranged on an upper front side with respect to the first sheet feed mechanism 31. The first conveying rollers 57 include a pair of a driving roller 68 and a driven roller 69. Each of the driving roller 68 and the driven roller 69 is configured to rotate about an axis extending in the right-left direction. The driving roller 68 and the driven roller 69 are arranged such that circumferential surfaces thereof are contacted with each other.

The second conveying rollers 58 are arranged on an upper rear side with respect to the fixing device 52, and on a lower rear side with respect to the discharge roller 56. The second conveying rollers 58 include a pair of a driving roller 71 and a driven roller 72. Each of the driving roller 71 and the driven roller 72 is configured to rotate about an axis extending in the right-left direction. the driving roller 71 and the driven roller 72 are arranged such that circumferential surfaces thereof contact each other.

Inside the casing 11, a first conveying path 81, a second conveying path 82, a third conveying path 83 and a fourth conveying path 84 are defined.

The first conveying path 81 is formed to have a U-shape staring from a contacting part of the separation roller 33 and the separation pad 34 toward an upper rear side through the first conveying rollers 57.

The second conveying path 82 extends rearward from the first conveying path 81, passing between the registration rollers 55, passing between the photosensitive drum 43 and the transfer roller 46, to a contacting part of the heat roller 53 and the pressure roller 54 of the fixing device 52, in this order.

The third conveying path 83 extends toward an upper rear side from the second conveying path 82, passing between the second conveying rollers 58, and is curved upward toward the upper front side to form the U-shape, and reaches the discharge port 64.

The fourth conveying path 84 extends from the multi-purpose tray 19, which is located at the used position, and is converged to the second conveying path 82 from the front side.

<Operation of Printer>

When an image is printed on the sheet, the sheet is fed from the sheet feed tray 16 or the multi-purpose tray 19.

When the sheet is fed from the sheet feed tray 16, the sheet feed roller 32 of the first sheet feed mechanism 31 is rotated counterclockwise when viewed from the left side of the printer 1. As the sheet feed roller 32 is rotated, the sheet contacting the circumferential surface of the sheet feed roller 32 is fed frontward. The sheet fed from the sheet feed tray 16 passes between the separation roller 33 and the separation pad 34, thereby the sheet being fed forward one by one. That is, even if a plurality of sheets are drawn from the sheet feed tray 16, it is ensured that only one sheet proceeds forward at a time since only one sheet is extracted from the other by the separation roller 32 and the separation pad 34. The sheet passed between the separation roller 33 and the separation pad 34 enters the first conveying path 81. The sheet entered the first conveying path 81 receives the conveying force from the first conveying rollers 57 and proceeds along the first conveying path 81. Since the first conveying path 81 has the U-shaped curve, the sheet proceeds along the first conveying path 81, makes a U turn at a front end part of the casing 12, proceeds rearward and enters the second conveying path 82.

When the sheet is fed from the multi-purpose tray 19, the sheet is fed by the second sheet conveying mechanism 36. The sheet fed from the multi-purpose tray 19 proceeds along the conveying path 84 toward the second conveying path 82. The sheet then inters the second conveying path 82 at a converging point of the second conveying path 82 and the fourth conveying path 84.

The sheet entered the second conveying path 82 proceeds rearward along the second conveying path 82. In this instance, the registration roller 55 is stopped (i.e., not rotated). When the leading end of the sheet has reached the registration rollers 55, proceeding of the sheet is once stopped.

Incidentally, the photosensitive drum 43 rotates clockwise when viewed from the left side of the printer 1. In accordance with rotation of the photosensitive drum 43, the circumferential surface of the photosensitive drum 43 is uniformly charge by the charger 44, and then selectively exposed to the laser beam emitted by the exposure device 51. With this exposure, charges on the circumferential surface of the photosensitive drum 43 are selectively removed, thereby a electrostatic latent image being formed on the circumferential surface of the photosensitive drum 43. The electrostatic latent image is developed to a toner image as the toner is supplied from the developer 45 through a developing roller 112.

Formation of the toner image and conveyance of the sheet are executed synchronously. That is, rotation of the registration rollers 55 is started such that the sheet is located between the photosensitive drum 43 and the transfer roller 46 when the toner image faces the transfer roller 46. To the transfer roller 46, a transfer bias is applied. When the sheet passes between the photosensitive drum 43 and the transfer roller 46, due to an effect of the transfer bias, the toner image is transferred from the circumferential surface of the photosensitive drum 43 to the upper surface of the sheet.

The sheet on which the toner image has been transferred further proceeds the second conveying path 82 rearward and enters the fixing device 52. In the fixing device 52, the sheet passes between the heat roller 53 and the pressure roller 54. At this stage, by the heat and pressure applied to the sheet carrying the transferred toner image, the toner image is permanently fixed on the sheet, thereby formation of the image on the sheet being achieved. The sheet on which the image has been formed proceeds from the second conveying path 82 to the third conveying path 83.

The sheet entered the third conveying path 83 receives the conveying force of the second conveying rollers 58 and proceeds along the third conveying path 83 toward the discharge roller 56. Then, the sheet receives the conveying force, from the discharge rollers 56, to move the sheet toward the discharge tray 24, and discharged, through the discharge port 64, onto the discharge tray 24.

As above, when the image is printed on the sheet, the sheet fed from the sheet feed tray 16 is conveyed through an S-shaped conveying path including the first conveying path 81, the second conveying path 82 and the third conveying path 83, or the sheet fed from the multi-purpose tray 19 is conveyed through a conveying path including the fourth conveying path 84, the second conveying path 82 and the third sheet conveying path 83. The image is formed on the sheet when the sheet is being conveyed, and the sheet on which the image has been formed is discharged on the discharge tray 24.

<Process Cartridge>

The cartridge frame 42, which is an example of a second cartridge, of the process cartridge 41 has a right side wall and a left side wall (not shown) which face each other, in the right-left direction, with a certain distance therebetween. Further, the cartridge frame 42 has an upper wall 93 bridged between the right side wall and the left side wall, a rear bottom wall 94 and a front bottom wall 95 as shown in FIG. 6. It is noted that the rear bottom wall 94 is not shown in FIGS. 7-9.

Figure 7:
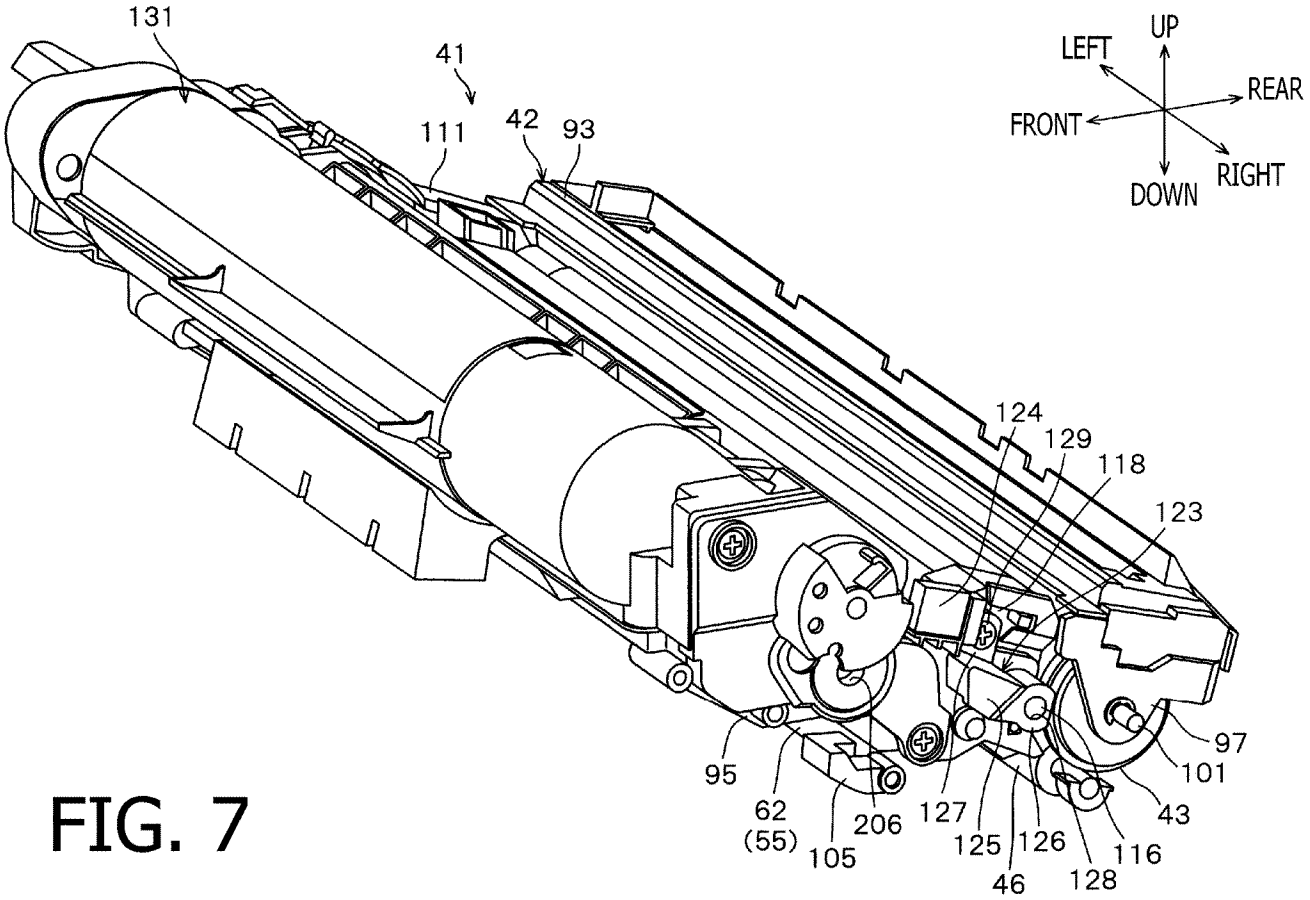
FIG. 7 is a perspective view, viewed from a right front side, of the process cartridge.
Figure 8:
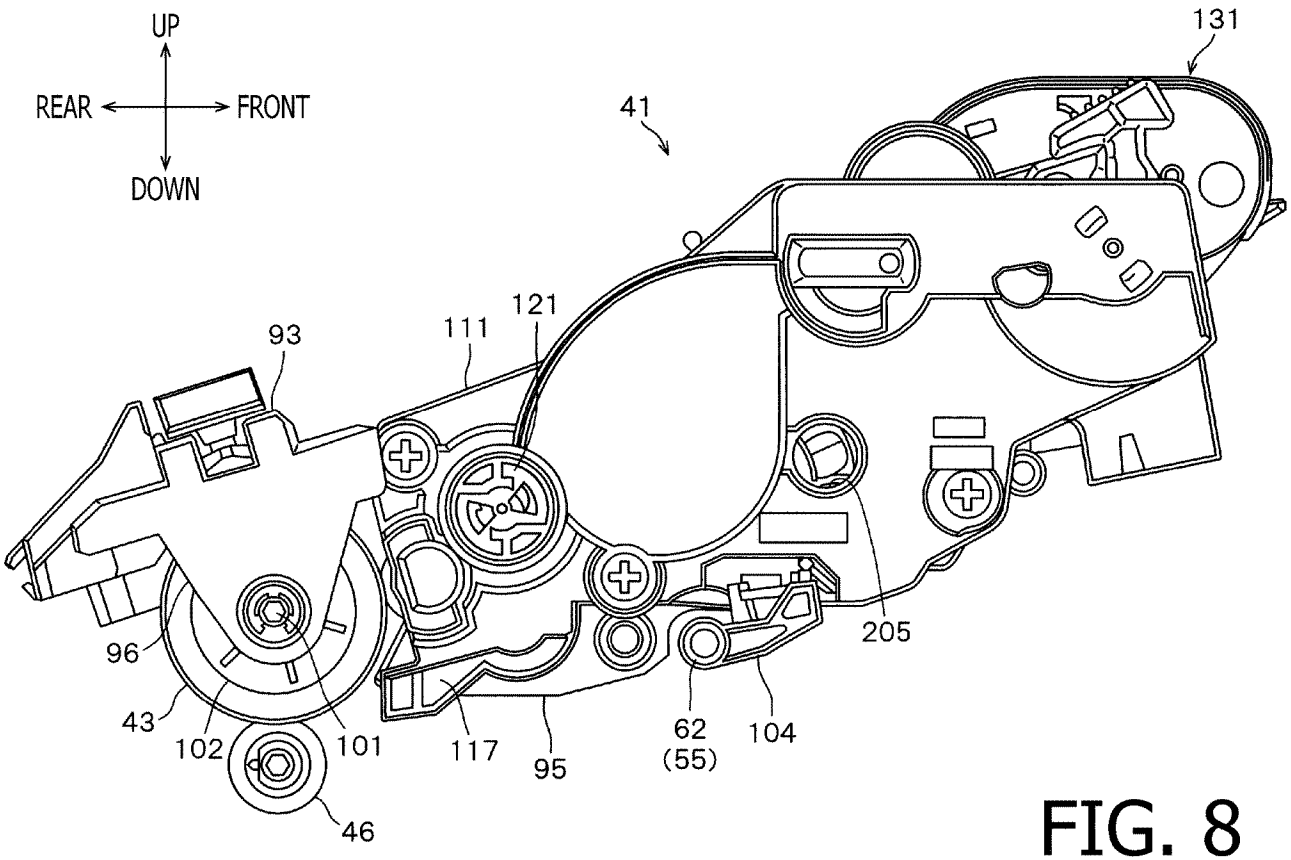
FIG. 8 is cross-sectional left side view of the process cartridge.
Figure 9:
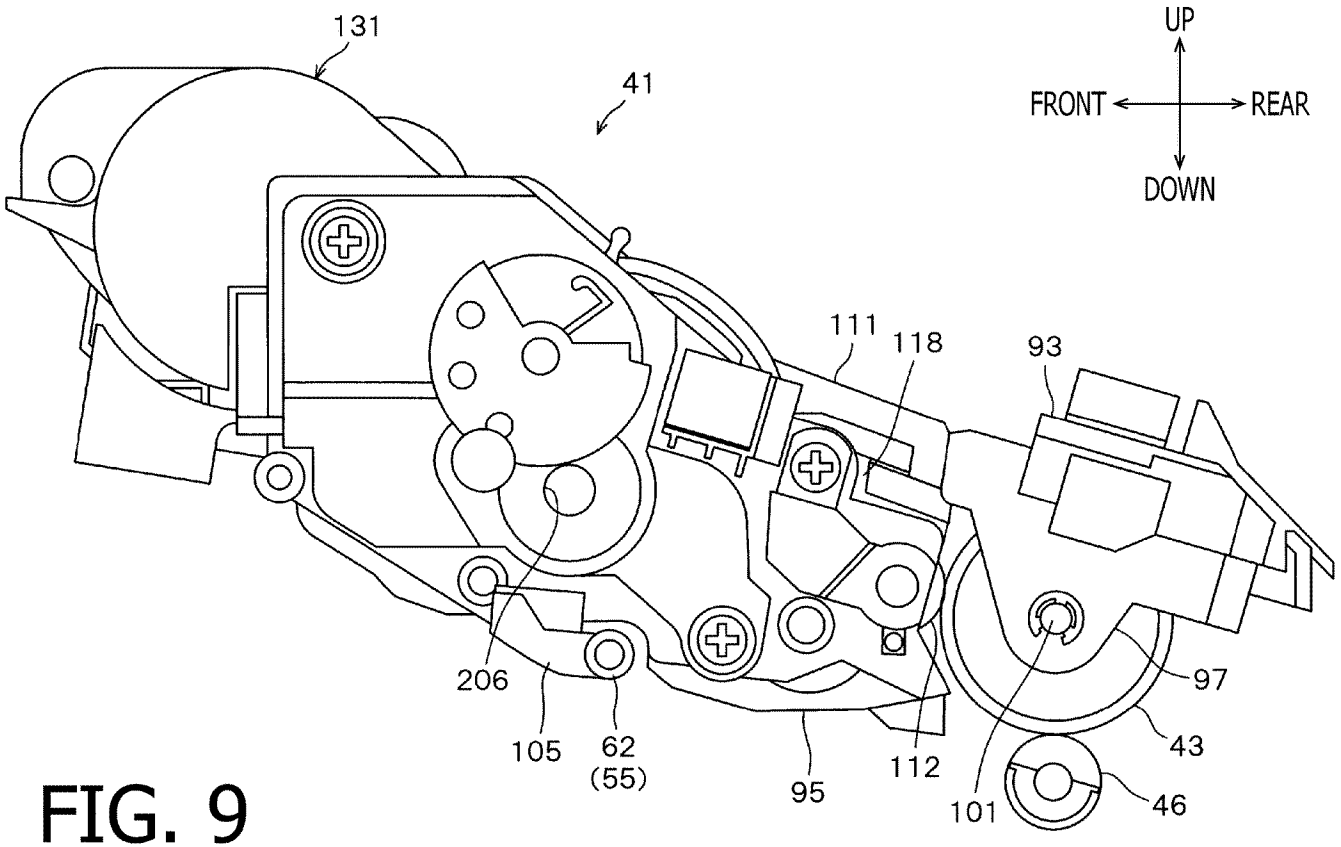
FIG. 9 is cross-sectional right side view of the process cartridge.

On the upper wall 93, as shown in FIG. 6, the charger 44 is held. On the left end part of the upper wall 93, a drum supporting part 96 is formed as shown in FIG. 8. The drum supporting part 96 has a substantially triangular and downwardly tapered shape in a side view. On a right end part of the upper wall 93, as shown in FIGS. 7 and 9, a drum supporting part 97 is formed. The drum supporting part 97 has a substantially triangular and downwardly tapered shape in a side view.

Between the drum supporting parts 96 and 97, a substantially cylindrical photosensitive drum 43 is arranged. The photosensitive drum 43 is rotatably supported by a drum shaft 101 which extends along an central axis of the photosensitive drum 43 such that the photosensitive drum 43 is rotatable with respect to the drum shaft 101. The left end part of the drum shaft 101 pierces through the drum supporting part 96 and protrudes to outside, as shown in FIG. 8, so that the left end part of the drum shaft 101 is non-rotatably supported by the drum supporting part 96. A right end part of the drum shaft 101 pierces through the drum supporting part 97 and protrudes to outside, as shown FIG. 9, so that the right end part of the drum shaft 101 is non-rotatably supported by the drum supporting part 97. At a left end part of the photosensitive drum 43, as shown in FIG. 8, a drum gear 102 is fixed.

The rear bottom wall 94 is arranged below the upper wall 93 as shown in FIG. 6. A rear end of the rear bottom wall 94 is downwardly spaced from the photosensitive drum 43, and is spaced from the transfer roller 46 rearward. The rear bottom wall 94 extends frontward from the rear end thereof along the circumferential surface of the transfer roller 46, and extends frontward such that the rear bottom wall 94 extends from a position facing a lower end of the circumferential surface of the transfer roller 46 to a position separating from the circumferential surface 46 of the transfer roller 46. The transfer roller 46 is rotatably supported by the rear bottom wall 94 and the circumferential surfaced of the transfer roller 46 contacts the circumferential surface of the photosensitive drum 43.

The front bottom wall 95 is configured such that the rear end part thereof overlaps the front end part of the rear bottom wall 94 with being spaced upwardly, and extends frontward from a position above the front end part of the rear bottom wall 94. Between the front end part of the rear bottom wall 94 and the rear end part of the front bottom wall 95, a slit 103 extending in the right-left direction is formed.

The sheet passed between the registration rollers 55 enters the slit 103, and proceeds in the slit 103 toward the contacting part of the photosensitive drum 43 and the transfer roller 46. Further, the sheet passed between the photosensitive drum 43 and the transfer roller 46 further proceeds to pass through a space between the photosensitive drum 43 and the rear end of the rear bottom wall 94.

On a left end of the front bottom wall 95, a roller holding part 104 is provided at a central part, in the front-end direction, as shown in FIG. 8. On a right end of the front bottom wall 95, at a right-left symmetric position with respect to the roller holding part 104 of the left side wall 91, a roller holding position 105 is provided as shown in FIGS. 7 and 9. To the roller holding parts 105 and 104, the right and left end parts of the driven roller 62 of the registration rollers 55 are rotatably held, respectively.

Above the front bottom wall 95, as shown in FIG. 6, the developer 45 is arranged. The developer 45 has a developer casing 11, which is an example of a second cartridge, a developing roller 112, a supplying roller 113 and an agitator 114.

The developing roller 112 has a substantially cylindrical developing roller main body 115, and a developing roller shaft 116 which is inserted in the developing roller main body 115 and extends along a central axis of the developing roller main body 115. The developing roller main body 115 is arranged between a left side wall 117 (see FIG. 8) and a right side wall 118 (see FIGS. 7 and 9) of the developer casing 11, and a part of a circumferential surface of the developing roller main body 115 is exposed outside from the developer casing 111 and contacts the circumferential surface of the photosensitive drum 43. The right end part and the left end part of the developing roller shaft 116 are inserted in the right side wall and the left side wall and rotatably held thereby, respectively.

The supplying roller 113 is arranged inside the developer casing 111, and a circumferential surface of the supplying roller 113 contacts the circumferential surface of the developing roller 12 from a lower front side.

The agitator 114 is arranged on the rear side with respect to the supplying roller 113, and attached to an agitator shaft 119 extending in the right-left direction. Right and left end parts of the agitator shaft 119 are inserted to the right side wall 118 and the left side wall 117 of the developer casing 111 and rotatably supported thereby.

On the left side wall 117 of the developer casing 11, at an upper front position with respect to the developing roller shaft 116, a passive coupling 121 is provided as shown in FIG. 8. The passive coupling 121 has a substantially cylindrical shape of which central axis extends in the right-left direction.

On the right side wall 118 of the developer casing 111, a developing bias terminal 123 and a supplying bias terminal 124 as shown in FIGS. 7 and 9.

The developing bias terminal 123 is made of electrically conductive resin and integrally provided with a contacting part 125, a connecting part 126 and a fixed part 127. The contacting part 125 is arranged on the front side with respect to the developing roller shaft 116, and has a planner surface extending in the front-rear and up-down directions. The connecting part 126 extends rearward from the contacting part 125, and has an insertion hole 125 in which the developing roller shaft 116 is inserted. The fixed part 126 extends upward from the contacting part 125, and is fixed to the right side wall 118 by means of a bolt 129.

The supplying bias terminal 124 is made of electrically conductive resin and arranged on an upper front side with respect to the developing bias terminal 123. The supplying bias terminal 124 is electrically connected to the supplying roller 113.

The process cartridge 41 is provided with a toner box 131 accommodating the toner, which is an example of a first cartridge. The toner box 131 is formed to have a hollow cylinder with both axial ends being closed, as shown in FIG. 7. The toner box 131 is configured to be detachably attached to a rear end part of the developer casing 111 between the right wall 118 and the left wall 117. When the process cartridge 41 is attached to the cartridge attachment position P, the toner box 131 is arranged on the first opening 13 side with respect to the exposure device 51, and the exposure device 51 and a part of the toner box 131 overlap in the up-down direction.

On one end part, in the right-left direction, of the toner box 131, a toner outlet 132 is formed as shown in FIG. 6. On the developer casing 111, a toner inlet 133 is formed at a position facing the toner outlet 132 from below when the toner box 131 is attached to the developer casing 111. Therefore, when the toner box 131 is attached to the developer casing 111, the toner outlet 132 and the toner inlet 133 communicate with each other, thereby inside the toner box 131 and inside the developer casing 111 communicate with each other through the toner outlet 132 and the toner inlet 133.

In the toner box 131, a toner conveying member 134 is provided. The toner conveying member 134 is, for example, a screw auger having helical blades provided around a shaft extending in the right-left direction, and both end parts of the shaft area rotatably supported by the toner box 131. A driving force is transmitted and the toner conveying member 134 starts rotating, by the blades of the toner conveying member 134, the toner inside the toner box 131 is conveyed toward the toner outlet 132. The toner reached to the toner outlet 132 is supplied from the toner outlet 132 to the developer casing 111 through the toner inlet 133.

<First Frame>

Figure 10:
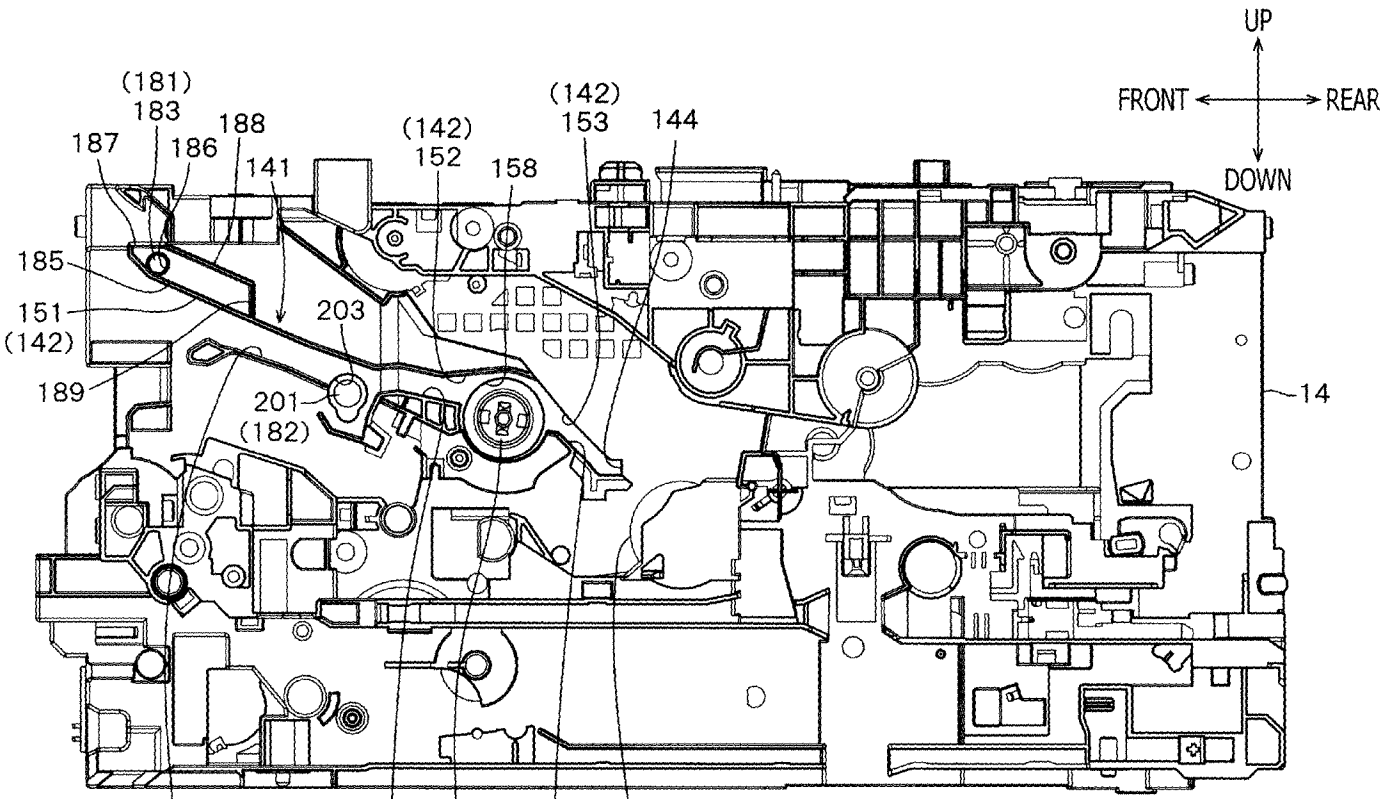
FIG. 10 is a cross-sectional right side view of a first frame.

To the first frame 14, as shown in FIG. 10, a guide part 141 for guiding attaching/detaching movement of the process cartridge 41 is provided. The guide part 141 is provided with an upper guide wall 142 protruding rightward from a right side surface of the first frame 14, a lower guide wall 143 and an end wall surface 144.

The upper guide wall 142 integrally includes a first wall 151, a second wall 152 and a third wall 153. The first wall 151 extends from an upper front part to a lower rear part of a right side surface of the first frame 14. The second wall 152 extends rearward from a rear end of the first wall 151. The third wall 153 extends downward from a rear end of the second wall 152.

The lower guide wall 143 has a fourth wall 154, a fifth wall 155 and a sixth wall 156 (which is an example of a supporting part). The fourth wall 154 is arranged below and extends substantially parallel to the first wall surface 151 of the upper guide wall 142 with a clearance therebetween. The fifth wall 155 is arranged below and extends substantially parallel to the second wall surface of the upper guide wall 142 with a clearance therebetween, and extends in a lower rear direction from a position spaced on the rear side with respect to the fourth wall surface. The sixth wall 156 is arranged below the third wall surface 153 of the upper guide wall 142 with a clearance therebetween, and extends, from a position spaced from a lower rear side with respect to the fifth wall surface 155, parallel to the third wall surface 153.

The end wall surface 144 is arranged between a rear end of the third wall surface 153 of the upper guide wall 142 and a rear end of the six wall surface 156 of the lower guide wall 143, and extends in the up-down direction.

A driving gear 157 configured to engage with the drum gear 102 of the process cartridge 41 is provided to the first frame 14 at a position separated from the rear end of the guide part 141 in the lower rear direction. The driving gear 157 is rotatably supported by the first frame 14 so as to be rotatable about an axis extending in the right-left direction. To the driving gear 157, a driving force of a motor (not shown) arranged on the left side with respect to the first frame 14 is transmitted.

On the first frame 14, a coupling arranging part 158 is formed as a circular opening piercing the first frame 14 in the right-left direction at a position facing the passive coupling 121 when the process cartridge 41 is attached to the cartridge attachment position P. To the coupling arranging part 158, the driving coupling 150 is provided. To the driving coupling 159, a driving force of the motor (not shown) arranged on the left side with respect to the first frame 14.

The driving coupling 159 is connected with an not-shown interlocking mechanism configured to move the driving coupling 159 between an advanced position at which the driving coupling 159 is advanced rightward from a coupling arranging part 158 and a retracted position at which the driving coupling 159 is retracted inside the coupling arranging part 158. When the front cover 17 is located at the opening position, the driving coupling 159 is located at the retracted position. When the front cover 17 is moved from the opening position to the closing position, the driving coupling 159 is moved from the retracted position to the advanced position.

<Second Frame>

Figure 11:
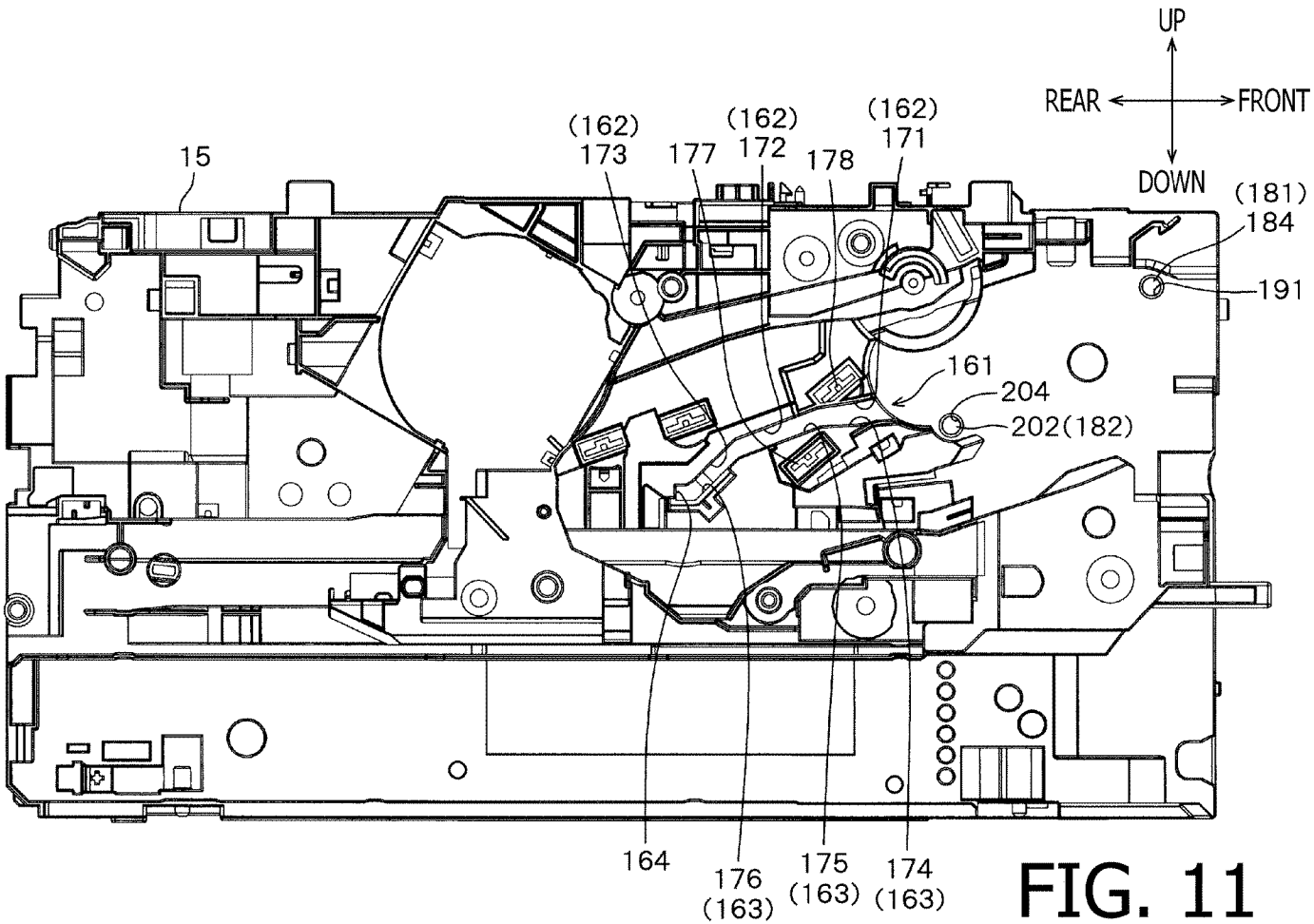
FIG. 11 is a cross-sectional left side view of a second frame.

To the second frame 15, as shown in FIG. 11, a guide part 161 guiding attaching/detaching of the process cartridge 41 is provided. The guide part 161 has an upper guide wall 162 protruding leftward from the left side surface of the second frame 15, a lower guide wall surface 163, and an end wall surface 164.

The upper guide wall surface 162 integrally has a first wall surface 171, a second wall surface 172 and a third wall surface 173. The first wall surface 171 extends rearward from a position on an upper side with respect to a central position in the up-down direction of a front end part of the left side surface of the second frame 15. The second wall surface 172 extends in an lower rear direction from a rear end of the first wall surface 171. The third wall surface 713 extends in a lower rear direction from the rear end of the second wall surface 172 at a larger inclination than the second wall surface 172.

The lower guide wall surface 163 has a fourth wall surface 174, a fifth wall surface 175 and a sixth wall surface 176. The fourth wall surface 174 is spaced downward from the first wall surface 171 of the upper guide wall surface 162 and extends substantially in parallel to the first wall surface 171. The fifth wall surface 175 is spaced downward from the second wall surface 172 of the upper guide wall surface 162, and extends, from the rear end of the fourth wall surface 174, in a lower rear direction, substantially in parallel with the second wall surface 172. The sixth wall surface 176 is spaced downward with respect to the third wall surface 173 of the upper guide wall surface 162, and extends, from the rear end of the fifth wall surface 175. substantially in parallel with the third wall surface 173.

The end wall surface 164 extends in the up-down direction between the rear end of the third wall surface 173 of the upper guide wall surface 162 and a rear end of the sixth wall surface 176 of the lower guide wall surface 163.

On the second frame 15, a developing bias electrode 177 is arranged at a position below the fifth wall surface 175 of the lower guide wall surface 163. Further, at a position above the first wall surface 171 of the upper guide wall surface 162, a supplying bias electrode 178 is arranged. Each of the developing bias electrode 177 and the supplying bias electrode 178 is made of a metal wire which integrally includes a wound part in which the metal wire is helically wound and an annular contact part formed on a left side with respect to the wound part. Further, each of the developing bias electrode 177 and the supplying bias electrode 178 pierces the second frame 15 and protrudes leftward from the left side surface of the second frame 15.

<Photosensor>

Figure 12:
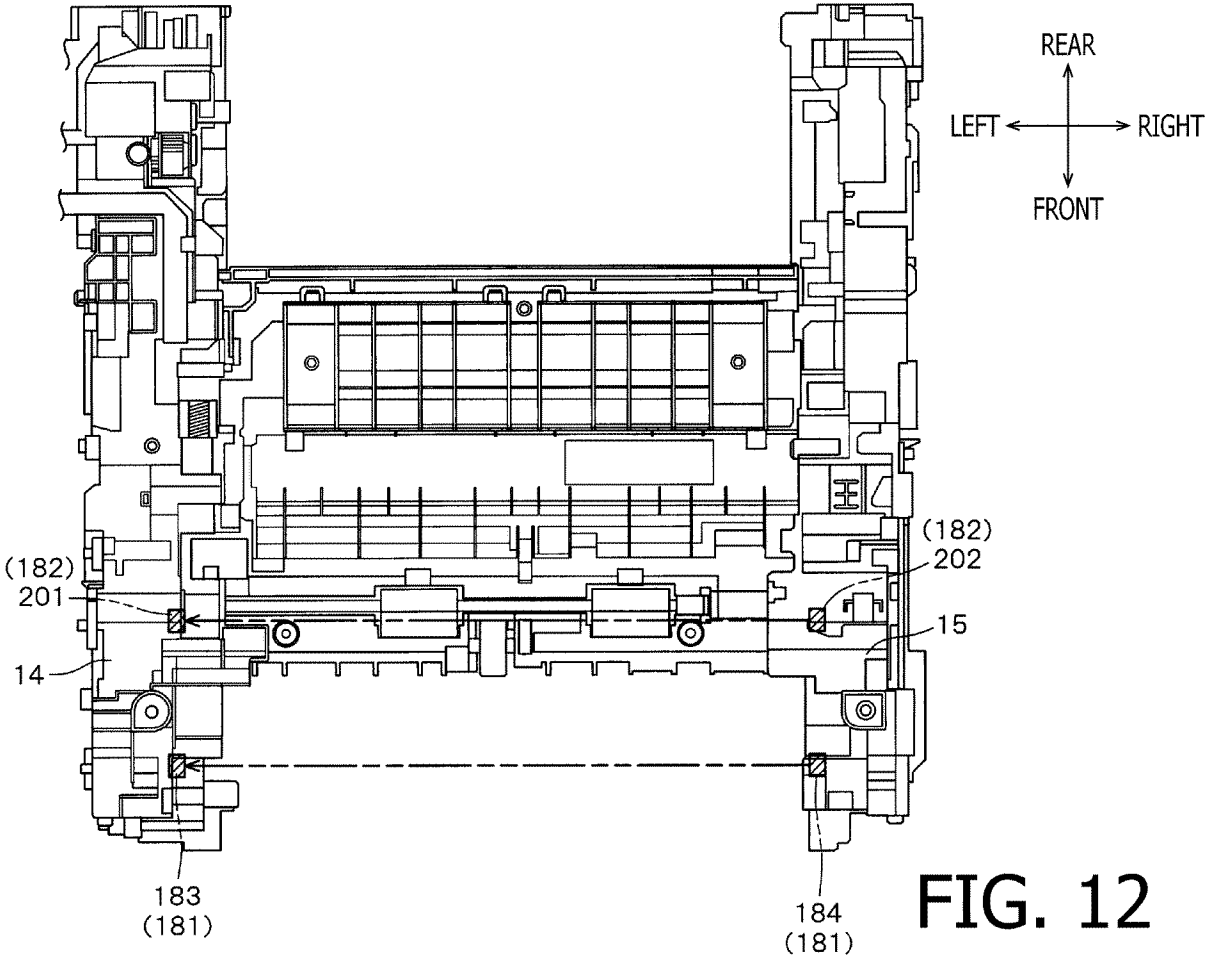
FIG. 12 is a plan view of an internal configuration of a casing of the image forming apparatus.

The printer 1 has a first photosensor 181 and a second photosensor 182 as shown in FIG. 12.

The first photosensor 181 is a transparent type photosensor having a light receiver 183 configured to receive light and a light emitter 184 provided to the second frame 15 and configured to emit light.

The light receiver 183 is provided to the first frame 14. The first wall surface 151 of the upper guide wall surface of the first frame 14 is formed as a lower surface of a first wall-like part 185 (which is an example of a light shielding part) protruding leftward from a right side surface of the first frame 14. The first wall-like part 185 is arranged between the light receiver 183 of the first photosensor 181 and the second opening 18. On an upper side of a front end part of the first wall-like part 185, a circular light receiving window 186 is formed. The light receiver 183 is arranged in the light receiving window 186 with a light receiving surface thereof being directed rightward.

On a right side surface of the first frame 14, as shown in FIG. 10, a second wall-like part 187, which is an example of a light shielding part), extending rearward from a front end of the first wall-like part 185, a third wall-like part 188, which is an example of the light shielding part, extending downward from the rear end of the second wall-like part 187, and a fourth wall-like part 189, which is also an example of the light shielding part, extending downward from the rear end of the third wall-like part 188 are formed. The lower end of the fourth wall-like part 189 is connected to the central part, in the front-rear direction, of the first wall-like part 185. With this configuration, the light receiving window 186 is surrounded by the first wall-like part 185, the second wall-like part 187, the third wall-like part 188 and the fourth wall-like part 189.

Figure 14:
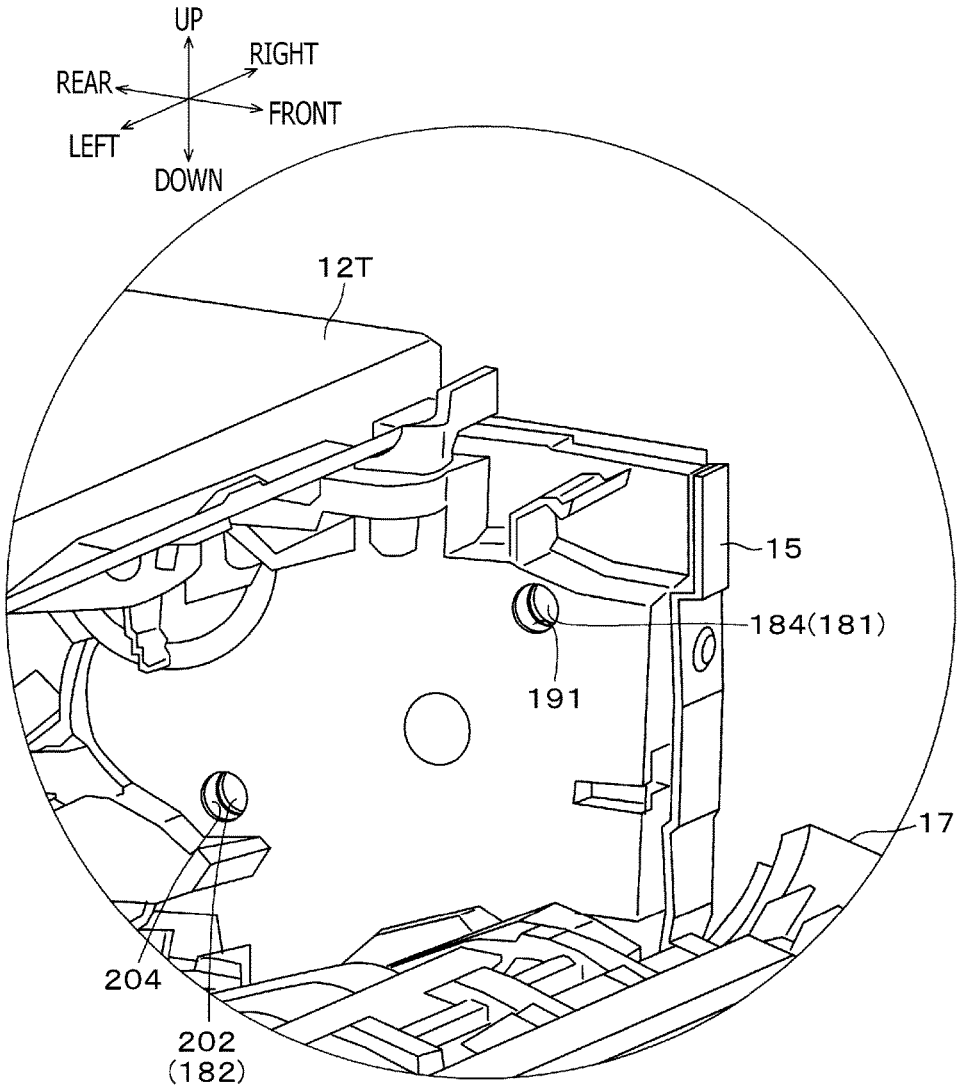
FIG. 14 is a perspective view of a circled portion in FIG. 4.

The light emitter 184 is provided to the second frame 15 as shown in FIG. 12. On the second frame 15, as shown in FIG. 14, a circular light emitting window 19 is formed at a position facing, in the right-left direction, the light receiving window 186. The light emitter 184 is arranged in the light emitting window 191 with a light emitting surface thereof being directed to the left side.

The light emitted by the light emitter 184 proceeds leftward from the light emitting window 191. When the process cartridge 41 is note attached to the cartridge attachment position P, the light emitted leftward from the light emitting window 191 passes through a space between the first frame 14 and the second frame 15, enters the light receiving window 185, and is incident on the light receiver 183.

Figure 13:
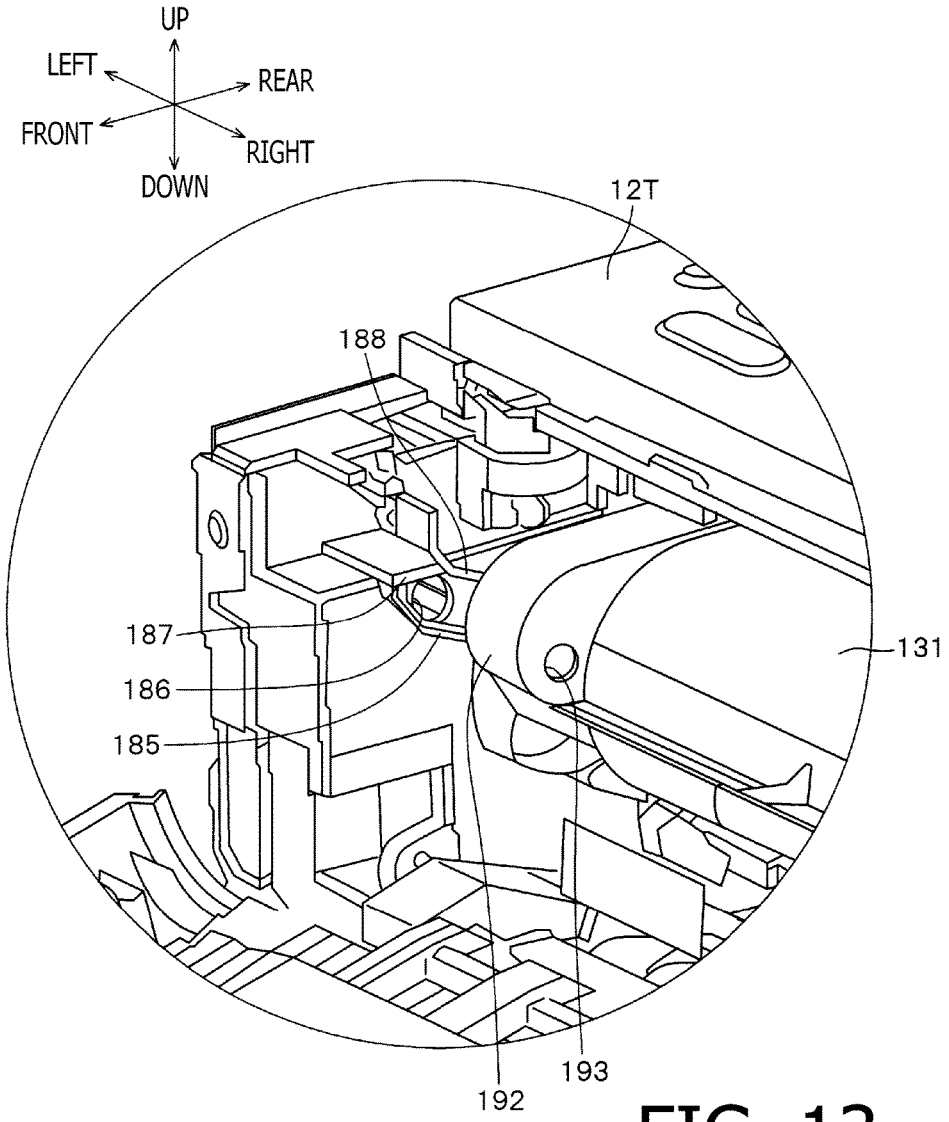
FIG. 13 is a perspective view of a circled portion in FIG. 2.

On a left end part of the toner box 131 attached to the process cartridge 41, as shown in FIG. 13, a swollen part 192, swollen frontward and having a substantially arcshaped side view, is formed. The swollen part 192 is a hollow part, and a driven gear fixed to a shaft of the toner conveying member, sector gears engaging with the driven gear and the like (not shown) are accommodated in the swollen part 192. The swollen part 192 is formed with a light passing hole 193 allowing the light emitted by the light emitter 184 toward the light receiver 183 to pass therethrough on a light path from the light emitter 184 to the light receiver 183.

The second photosensor 182 is a transparent type photosensor having a light receiver 201 configured to receive light, and a light emitter 202 configured to emit light.

The light receiver 201 is provided to the first frame 14. On the first frame 14, as shown in FIG. 10, a light receiving window 203 is formed between the fourth wall 154 and the fifth wall 155 of the guide part 141. The light receiver 201 is arranged in the light receiving window 203 with the light receiving surface thereof being directed rightward.

The light emitter 202 is provided to the second frame 15. On the second frame 15, as shown in FIGS. 11 and 14, a circular light emitting window 204 is formed at a position facing, in the right-left direction, the light receiving window 203. The light emitter 202 is arranged in the light emitting window 204 with a light emitting surface thereof being directed leftward.

The light emitted by the light emitter 202 proceeds leftward from the light emitting window 204. The light emitted from the light emitting window 204 passes through a space between the first frame 14 and the second frame 15, enters the light receiving window 203 and is incident on the light receiver 201.

On the left side wall 117 of the developer casing 111 of the process cartridge 41, as shown in FIG. 8, a light transmission window 205 allowing the light proceeding from the light emitter 202 toward the light receiver 201 to pass therethrough when the process cartridge 41 is attached to the cartridge attachment position P is formed at a position facing, in the right-left direction, the light receiver 201. Further, on the right side surface 118 of the developer casing 111, as shown in FIG. 9, a light transmission window 206 allowing the light proceeding from the light emitter 202 toward the light receiver 201 to pass therethrough when the process cartridge 41 is attached to the cartridge attachment position P is formed at a position facing, in the right-left direction the light emitter 202.

<Attachment/Detachment of Process Cartridge>

When the process cartridge 41 is attached, the front cover 17 is moved from the closing position to the opening position, and the process cartridge 41 is inserted, through the first opening 13, to a space between the first frame 14 and the second frame 15. In this instance, the left end part of the dram shaft 101 is received between the upper guide wall 142 and the loser guide wall 143 of the guide part 141, and the right end part of the drum shaft 101 is received between the upper guide wall 162 and the lower guide wall 162 of the guide part 161. Thereafter, the process cartridge 41 is pushed rearward, and the right and left end parts of the dram shaft 101 moves along the guide parts 161 and 141, respectively, the process cartridge 41 is guided from an upper side to a lower side as the process cartridge 41 approaches the cartridge attachment position P.

When the left end part and the right end part of the drum shaft 101 respectively contact the end wall surfaces 144 and 164, a further movement of the process cartridge 41 is restricted. According to this configuration, the process cartridge 41 reaches the cartridge attachment position P, thereby attachment of the process cartridge 41 to the cartridge attachment position P being achieved.

When the process cartridge 41 is attached to the cartridge attachment position P, the drum gear 10 of the process cartridge 41 engages with the driving gear 157 provided to the first frame 14. Accordingly, the driving force of the motor can be transmitted from the driving gear 157 to the drum gear 102, and it becomes possible to rotate the photosensitive drum 43 by the driving force as transmitted.

The left end part of the drum shaft 101 contacts the end wall surface 144 from the front side, and is supported by the sixth wall surface 156 of the lower guide wall 143 from below. Further, the right end part of the drum shaft 101 contact the end wall surface 164 from the front side, and is supported by the sixth wall surface 176 of the lower guide wall surface 163 from below. Further, to the developing bias terminal 123 and the supplying bias terminal 124 of the process cartridge 41, the developing bias electrode 177 and the supplying bias electrode 178 provided to the second frame 15 elastically contact, respectively. By the elastic forces the developing bias electrode 177 and the supplying bias electrode 178 have, the process cartridge 41 is urged leftward, thereby the left end of the drum shaft 101 contacting the right side surface of the first frame 14. As a result, positioning of the process cartridge 41 at the cartridge attachment position P is done based on the right side surface of the first frame 41.

Further, the coupling arranging part 158 of the first frame 1 faces the passive coupling 121 of the process cartridge 41 from the left side. When the front cover 17 is moved from the opening position to the closing position, the driving coupling 159 advances from the retracted position to the advanced position, thereby the driving coupling 159 engaging with the passive coupling 121. As a result, the driving force of the motor can be input to the passive coupling 121 through the driving coupling 159. The driving force input to the passive coupling 121 is transmitted, through a not-shown gear train, to the developing roller 112, the supplying roller 113 and the agitator 114, and rotates the developing roller 112, the supplying roller 113 and the agitator 114, respectively.

As the agitator 114 rotates, the toner in the developer casing 111 is stirred up. The light emitted by the light emitter 202 of the second photosensor 18 enters inside the developer casing 111 through the light transmission window 206 of the developer casing 111. The light is shielded by the toner stirred up inside the developer casing 111. The amount of the toner stirred up inside the developer casing 111 depends on the remaining amount of the toner inside the developer casing 111. That is, when a relatively large amount of toner remains inside the developer casing 111, the amount of the toner stirred up in the developer casing 111 is also large, while a relatively small amount of toner remains inside the developer casing 111, the amount of the toner stirred up in the developer casing 111 is also small. When the developer casing 111 is almost empty, a time period during which the light proceeding from the light transmission window 206 to the light transmission window 205 is short. Therefore, depending on a signal output by the light receiver 201, whether the developer casing 111 is empty or not can be detected.

When the toner box 131 is in a new state, the light passing hole 193 is opened, and the light emitted by the light emitter 184 of the first photosensor 181 passes through the light passing hole 193 and is incident on the light receiver 183. When the driving force input to the passive coupling 121 is transmitted to the driven gear accommodated in the swollen part 192 of the toner box 131 through the not-shown gear train, the toner conveying member rotates together with the driven gear, and the toner is supplied from the toner box 131 to inside of the developer casing 111. When the toner box 131 is new and the toner conveying member is rotated first time, the driving force is transmitted from the driven gear to the sector gear accommodated in the swollen part 192 and the sector gear rotates. In accordance with rotation of the sector gear, a light shielding member (not shown) moves to a position where the light shielding member faces the light passing hole 193. When the sector gear has rotated at a position where a tooth lacking part of the sector gear faces the driving gear, engagement between the sector gear and the driven gear is released, and rotation of the sector gear is stopped. At this stage, the light shielding member faces the light passing hole 193. Thereafter, even when the toner conveying member rotates, the sector gear does not rotate, and a state where the light shielding member faces the light passing hole 193 is maintained. Therefore, the light emitted by the light emitter 184 of the first photosensor 181 does not pass through the light passing hole 193. Thus, the light does not reach the light receiver 183. Accordingly, based on the signal output by the light receiver 183, whether the toner box 131 is attached or not can be detected.

When the process cartridge 41 is to be detached from the casing 11, the front cover 17 is moved from the closing position to the opening position. In association with displacement of the front cover from the closing position to the opening position, the driving coupling 159 moves from the advanced position to the retracted position, and the engagement between the driving coupling 159 and the passive coupling 121 is released. When the process cartridge 41 is drawn frontward from the cartridge attachment position P, the left end part and the right end part of the drum shaft 101 moves along the guide parts 141 and 161, respectively, thereby the process cartridge 41 being guided to move from a lower position to an upper position as the process cartridge 41 moves away from the cartridge attachment position P. When the process cartridge 41 is drawn out of the casing 11 through the first opening 13, detachment of the process cartridge 41 has been completed.

<Effects>

As described above, on the front surface 12F of the casing 11, the first opening 13 is formed bridging to the upper surface 12T. Inside the casing 11, the first frame 14 and the second frame 15 are arranged so as to be spaced from each other in the right-left direction which is parallel to the front surface 12F. At a position sandwiched between the first frame 14 and the second frame 15, the cartridge attachment position P is set, and the process cartridge 41 is configured to be detachably attached to the cartridge attachment position P. The process cartridge 41 has a cartridge frame 42 supporting the photosensitive drum, the cartridge frame 42 supporting the developer casing 111, and the tonner box 131 accommodating the toner.

On the first frame 14, the light emitter 183 of the photosensor 181 is arranged. On the second frame 15, the light emitter 184 of the photosensor 181 is arranged. The process cartridge 41 is located at the cartridge attachment position P, the light emitted by the light emitter 184 is shielded by the toner box 131 located at the cartridge attachment position P. When the process cartridge 41 is not attached to the cartridge attachment position P, the light emitted by the light emitter 184 is incident on the light receiver 183. Thus, depending on whether the light receiver 183 receives the light, it becomes possible to determine whether the process cartridge 41 is attached to the cartridge attachment position P.

To the front cover 17 which opens/closes the first opening 13, a second opening 18, through which the sheet passes, is formed. Between the light receiver 183 of the first photosensor 181 and the second opening 18, the first wall-like part 185 is provided. External light interring inside the casing 11 through the second opening 18 is shielded by the first wall-like part 185. Therefore, with the above configuration, incidence of the external light on the light receiver 183 of the first photosensor 181 can be restricted.

The first wall-like part 185 has a first wall surface 151 of the upper guide wall 142 configured to guide attachment of the process cartridge 41 to the cartridge attachment position P. With this configuration, shielding of the external light entering from the second opening 18 can be realized with a relatively small space. Accordingly, even if the printer 1 has only a limited space to employ an external light shielding structure, it is possible to restrict incidence of the external light on the first photosensor 181.

Further, in the printer 1, the second wall-like part 187 extending rearward from the front end of the first wall-like part 185, the third wall-like part 188 extending in the lower front direction from the rear end of the second wall-like part 187, and the fourth wall-like part 189 extending downward from the rear end of the third wall-like part 188. The lower end of the fourth wall-like part 189 is connected to the central part, in the front-rear direction, of the first wall-like part 185. That is, the light receiving window 186 is surrounded by the first wall-like part 185, the second wall-like part 187, the third wall-like part 188 and the fourth wall-like part 189. Accordingly, it is possible to restrict not only the external light linearly directed from the second opening 18 toward the light receiver 183, but the external light (and reflected light) entering the casing 11 through the first opening 13 and/or light reflected inside the casing 11 from being incident on the light receiver 183.

The second photosensor 182 is provided to the printer 1. The second photosensor 182 is provided with the light emitter 202 configured to emit light, and the light receiver 201 configured to receive the light emitter by the light emitter 202. The light receiver 201 and the light emitter 202 are respectively arranged on the first frame 14 and the second frame 15. The light emitted by the light emitter 202 proceeds to transverse the developer casing 111 in the right-left direction, and is incident on the light receiver 291. As the agitator 114 rotates, the toner is stirred up inside the developer casing 111, and the light transversely proceeding inside the developer casing 111 is shielded by the stirred-up toner. A time period during which the light is shielded by the stirred-up toner depends on the remaining amount of the toner in the developer casing 111. Accordingly, based on the signal output by the light receiver 20, the empty state of the toner in the developer casing 111 can be detected.

<Modification>

It is note that aspects of the present disclosures need not be limited to the above-described configuration of the illustrative embodiment, but can be embodied in various ways without departing from the aspects of the disclosures.

In the above description, the printer 1 is described as an example of an image forming apparatus. However, the image forming apparatus need not be limited to the printer 1 which has a single function, but may be modified in various ways. For example, the image forming apparatus may be a facsimile device or an MFP having an image forming function and an image reading function.

Various modifications in terms of design of the above-described configuration can be made without departing from aspects of the disclosures.

What is claimed is:

1. An image forming apparatus comprising:

a casing having a first opening on a front surface of the casing;

a first frame and a second frame arranged inside the casing;

a cartridge detachably attached to, through the first opening, an attachment position defined between the first frame and the second frame, the first frame and the second frame facing each other across the attachment position;

a photosensor including a light receiver provided to the first frame and a light emitter provided to the second frame and configured to emit light toward the light receiver, the light receiver being positioned such that the light emitted by the light emitter is shielded by the cartridge and does not reach the light receiver when the cartridge is attached to the attachment position, while the light emitted by the light emitter reaches the light receiver when the cartridge is detached from the attachment position;

a door movably secured to the casing, the door being movable between a closing position to close the first opening and an opening position to open the first opening, a second opening allowing a sheet to pass through being formed on the door; and a light shielding part provided to the first frame, the light shielding part being located between the light receiver and the second opening when the door is located at the closing position so that external light entering the casing through the second opening and directed toward the light receiver is shielded by the light shielding part, wherein the light shielding part serves as a guiding part to guide the cartridge toward the attachment position.

2. The image forming apparatus according to claim 1, wherein the light shielding part is formed to be a wall surrounding the light receiver.

3. The image forming apparatus according to claim 1, wherein the cartridge comprises:

a first cartridge accommodating a toner; and a second cartridge supporting a photosensitive drum, wherein the photosensor is arranged to such that the light emitted by the light emitter is shielded by the first cartridge when the cartridge is attached to the attachment position.

4. The image forming apparatus according to claim 3, further comprising a second photosensor including a second light receiver provided to the first frame and a second light emitter provided to the second frame and configured to emit light toward the second light receiver, the second light receiver being positioned such that, when the cartridge is attached to the attachment position, the light emitted by the second light emitter and passing through the second cartridge is received.

5. The image forming apparatus according to claim 3, further comprising an exposure device configured to expose a surface of the photosensitive drum with light in accordance with image data, wherein, when the first cartridge is attached to the attachment position, the first cartridge is located on a first opening side with respect to the exposure device, the first cartridge and the exposer device overlapping in a direction perpendicular to an upper surface of the casing.

6. The image forming apparatus according to claim 5, wherein the first opening is formed over the front surface and the upper surface of the casing.

7. The image forming apparatus according to claim 1, wherein the first opening is formed over the front surface and an upper surface of the casing.

8. An image forming apparatus comprising:

a casing having a first opening;

a door movable between a closing position to close the first opening and an opening position to open the first opening, the door having a second opening allowing a sheet to pass through the door;

a cartridge detachably attached to, through the first opening, an attachment position inside the casing;

a first frame arranged inside the casing, the first frame comprising:

a light receiver configured to detect light; and a first guiding part configured to guide the cartridge toward the attachment position, a part of the first guiding part located between the light receiver and the second opening when the door is located at the closing position so that external light entering the casing through the second opening and directed toward the light receiver is shielded by the part of the first guiding part;

a second frame arranged inside the casing, the second frame facing the first frame across the cartridge when the cartridge is attached at the attachment position, the second frame comprising:

a light emitter configured to emit light, the light emitter facing the photo light receiver across the cartridge when the cartridge is attached at the attachment position; and a second guiding part configured to guide the cartridge toward the attachment position.

* * * * *